United States Patent [19]

Nakayama et al.

[11] Patent Number: 4,524,296

[45] Date of Patent: Jun. 18, 1985

[54] CATHODE STRUCTURE FOR ELECTRON TUBE

[75] Inventors: Shouji Nakayama, Yokosuka; Yukio Takanashi, Hiratsuka; Toshiharu Higuchi; Touru Yakabe, both of Yokohama, all of Japan

[73] Assignee: Tokyo Shibaura Denki Kabushiki Kaisha, Japan

[21] Appl. No.: 445,756

[22] Filed: Dec. 1, 1982

[30] Foreign Application Priority Data

Dec. 11, 1981 [JP] Japan ..... 56-198488

[51] Int. Cl.[3] ..... H01J 1/94; H01J 1/26; H01J 19/48

[52] U.S. Cl. ..... 313/270; 313/292; 313/38; 313/340; 313/337

[58] Field of Search ..... 313/270, 292, 337, 341, 313/38, 340

[56] References Cited

U.S. PATENT DOCUMENTS

| | | | |
|---|---|---|---|
| 3,440,475 | 3/1969 | Schiller et al. | 313/337 |
| 3,497,757 | 1/1970 | Zalm et al. | 313/346 |
| 4,298,814 | 11/1981 | Takanashi et al. | 313/302 |
| 4,355,259 | 10/1982 | Weiss | 313/337 |

FOREIGN PATENT DOCUMENTS

| | | |
|---|---|---|
| 46-19714 | 7/1971 | Japan . |
| 47-23954 | 7/1972 | Japan . |
| 54-25962 | 8/1979 | Japan . |
| 545351 | 10/1936 | United Kingdom . |
| 641581 | 8/1950 | United Kingdom . |
| 715974 | 9/1954 | United Kingdom . |
| 810101 | 3/1959 | United Kingdom . |
| 857090 | 12/1960 | United Kingdom . |
| 1264087 | 2/1972 | United Kingdom . |

OTHER PUBLICATIONS

Peterson et al., "Indirectly Heated Cathode Construction", RCA Technical Notes, No. 173, Aug. 1958.

*Primary Examiner*—David K. Moore
*Assistant Examiner*—Vincent DeLuca
*Attorney, Agent, or Firm*—Cushman, Darby & Cushman

[57] ABSTRACT

A cathode structure includes a thermal conductive member, a heater for heating a thermal conductive member, a metal substrate having a first surface facing a thermal conductive member and a second surface and attached to the thermal conductive member to form a space between a central portion of a second surface and the thermal conductive member, and an electron emitting member provided on a second surface of a metal substrate.

9 Claims, 12 Drawing Figures

CATHODE STRUCTURE FOR ELECTRON TUBE

BACKGROUND OF THE INVENTION

The present invention relates to a cathode structure for an electron tube, and particularly relates to a rapid start cathode structure suitable for a color cathode ray tube.

FIG. 1 shows a prior art rapid start cathode structure disclosed in Japanese Utility Model Publication No. 23954/1972. Heaters 1 are inserted in a cathode sleeve 2 and an electron emitting layer 3 is provided on a top surface 4 of the cathode sleeve. Heater 1 includes a tungsten coiled filament 7 and a sintered alumina insulating layer 8 covering the filament. The outer surface of heater 1 is substantially surrounded by sleeve 2. At first, cathode sleeve 2 is formed a sleeve of rectangular cross section as shown in FIG. 2 and an inner space of the sleeve is so designed to have a clearance when heaters 1 are inserted in the sleeve. Then, in a press forming step, a forming apparatus 10 is moved in a direction indicated by an arrow 11 to produce the relation between the cathode sleeve and the heaters mentioned above.

In this cathode structure, the cathode sleeve overlaps and contacts with the outer surfaces of the heaters. Thermal and a mechanical coupling between the heaters and the cathode sleeves is thereby greatly increased. Drawbacks caused by a gap therebetween are eliminated and high heating efficiency is obtained. Therefore, this cathode structure is useful as a rapid start cathode structure. However, this cathode structure has additional fatal drawbacks as follows.

First, a reaction shown by $W+Al_2O_3 \rightarrow W_mO_n+Al$ (wherein m and n are integral number) occurs between the tungsten filament and the alumina insulating layer. Oxygen contained in the resultant $W_mO_n$ diffuses into the cathode sleeve and reacts with the electron emitting layer, resulting in so called gas dope phenomenon. As a result, the life of the cathode structure is extremely shortened.

Second, the neck of the color cathode ray tube is commonly narrowed in diameter. However this prior art cathode structure cannot be practically narrowed. In a color cathode ray tube having an in-line type electron gun the ability to narrow neck diameter is important.

SUMMARY OF THE INVENTION

A primary object of the present invention is to provide a cathode structure in which the neck diameter of a color cathode ray tube can be narrowed.

Another object of the present invention is to provide a cathode structure which operates quickly and has a long lifetime.

Therefore the present invention provides a cathode structure for an electron tube having a thermal conductive member, a heater for heating a thermal conductive member, a metal substrate having a first surface facing a thermal conductive member and a second surface and attached to a thermal conductive member to form a space between a central portion of a second surface and the thermal conductive member, and an electron emitting member provided on a second surface of a metal substrate.

BRIEF DESCRIPTION OF THE DRAWINGS

The invention will be described in detail with reference to the accompanying drawings, wherein.

DETAILED DESCRIPTION OF THE PREFERRED EMBODIMENT

Figure 1:
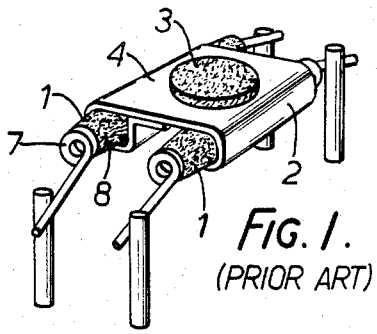
FIG. 1. (PRIOR ART)
FIG. 1 is a perspective view of a prior art cathode structure.
Figure 2:
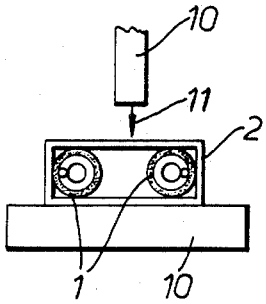
FIG. 2. (PRIOR ART)
FIG. 2 is a side view of a prior art cathode structure showing one step of manufacturing.
Figure 3:
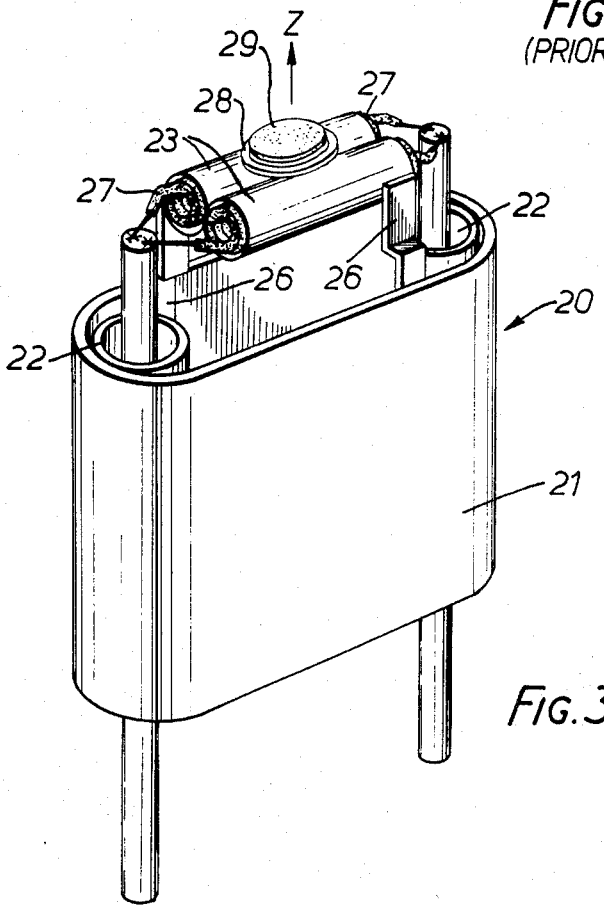
FIG. 3 is a perspective view of a cathode structure of the present invention.

Referring now to FIGS. 3, 4, 5, and 6, the cathode structure 20 of the present invention includes an elliptic cylindrical cathode holder 21 having two surfaces parallel to each other and being made of Fe-Ni-Co alloy of 0.15 mm in thickness. A pair of conducting members 22 is attached to an inner wall of the cathode holder and a pair of cathode sleeves 23 defining a thermal conductive member is supported by the cathode holder through supporting members 26 welded to the inner wall of the cathode holder. The heaters 27 are inserted in the cathode sleeves respectively, the ends of which are welded to the conducting members. A metal substrate 28 is attached to the cathode sleeves and an electron emitting layer 29 is provided on metal substrate 28.

Figure 4:
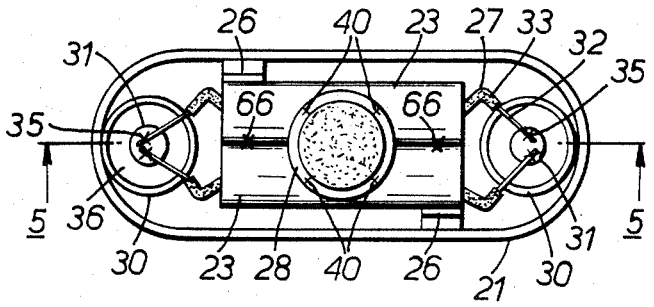
FIG. 4 is a top view of the cathode structure shown in FIG. 3.
Figure 5:
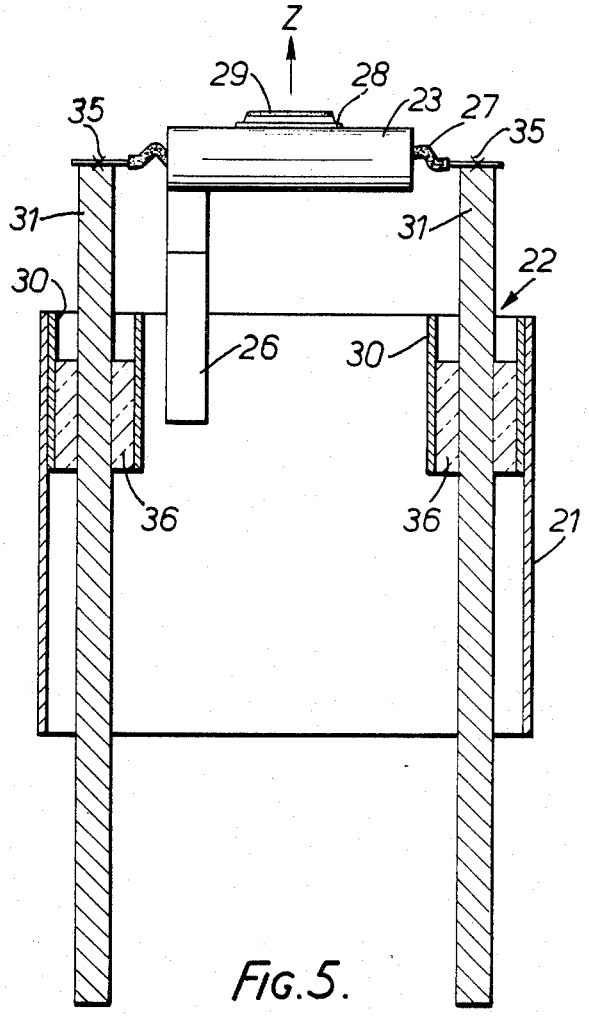
FIG. 5 is a cross section taken along 5—5 of the cathode structure shown in FIG. 4.
Figure 6:
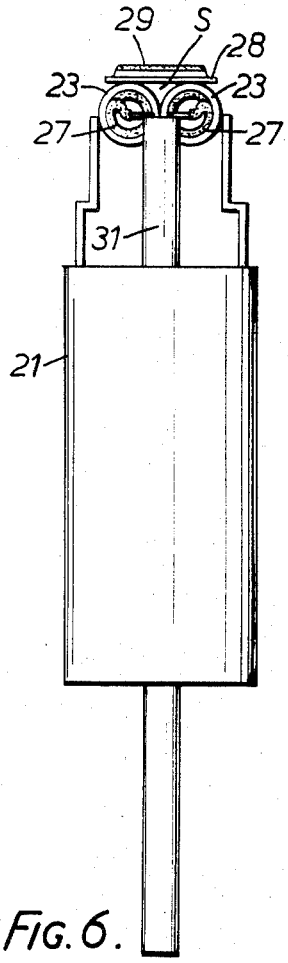
FIG. 6 is a side view of the cathode structure shown in FIG. 3.

As can be seen in FIGS. 4 and 6, conducting member 22 has a cylinder 30 welded to cathode holder 21, and a conductive rod 31 inserted through cylinder 30 and fixed thereto by an insulating material 36, for example adhesive glass. Cathode sleeve 23 is made of Ni-Cr-W alloy and is 0.8 mm in diameter, 15 $\mu$m in thickness and 3 mm in length. On the inner and outer surfaces of cathode sleeve 23, a blackened layer is formed. The cathode sleeves 23 are arranged in a plane perpendicular to an electron gun axis Z (described hereinafter) and are welded to each other at the contacting points 66. Cathode sleeves 23 are supported by a pair of supporting members 26 at their end portions symmetrically with respect to the electron gun axis Z. The other ends of supporting members 26 are welded to the inner wall of cathode holder 21. Heater 27 has a coiled tungsten filament 32 and an alumina insulating layer 33 covering coiled filament 32. The heater is inserted in the cathode sleeve and the ends of the filament are each electrically connected to one end of conductive rods 31 respectively at the welding points 35. The other ends of conductive rods 31 are connected to a power source. Metal substrate 28 is a metal disk made of nickel mainly including a very small amount of reducing agent, and has a diameter of 1.3 mm and a thickness of 0.04 mm. On the metal substrate, electron emitting layer 29 is provided. The metal substrate is placed on both of cathode sleeves 23 along their top surfaces and is welded to the cathode sleeves at two or four points 40 about the peripheral portion of the metal substrate. The center of the metal substrate is aligned to the electron gun axis Z. To this end, a space S is formed between the cathode sleeves 23 and the central portion of the metal substrate 28.

Now an in-line electron gun assembly for a color cathode ray tube applying the cathode structure of the present invention described above will be described.

Figure 7:
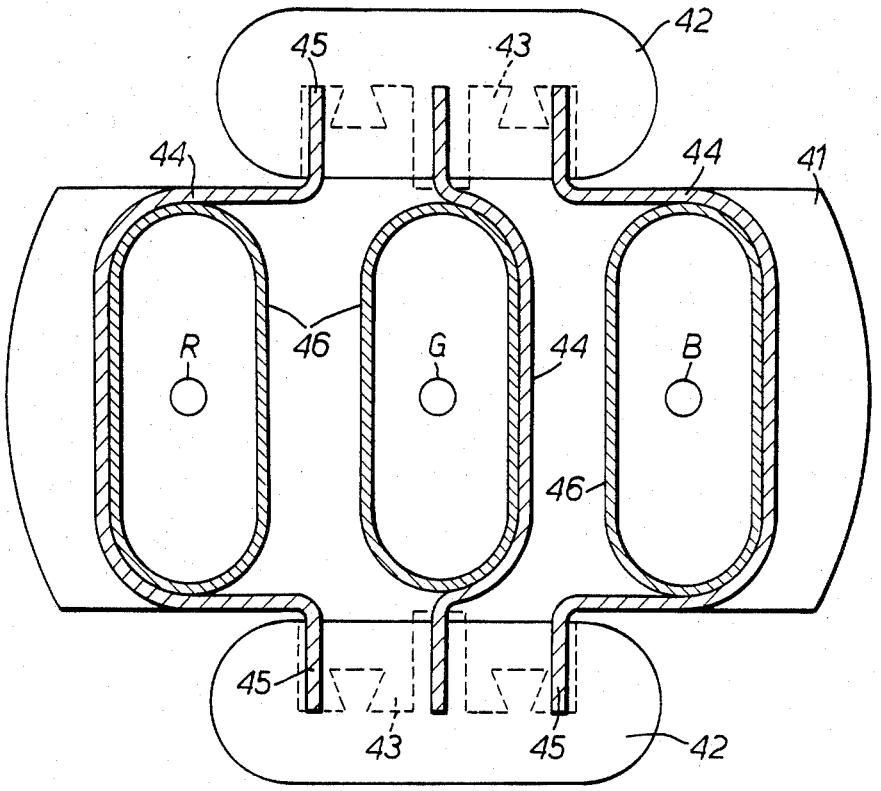
FIG. 7 is a cross section of an electron gun assembly for employing the present invention cathode structure.

FIG. 7 shows a cross section of the in-line electron gun assembly cutting along a plane perpendicular to the electron beam traveling direction defining an electron gun axis and seen from the cathode side to grid electrodes. A first grid electrode 41 has three apertures R, G and B arranged in-line for three electron beams passing through respectively and is fixed to bead glasses 42 through fixing portions 43 thereof. Other grid electrodes (not shown) are also fixed to the bead glasses separately from each other in the direction of the electron gun axis. Further, three cathode support plates 44 are fixed to the bead glasses by their fixing portions 45 and three cylindrical cathode supports 46 are fixed to the cathode support plates respectively by welding.

The cathode structures of the present invention are inserted into the cylindrical cathode supports respectively. The clearances between the first grid electrode and the electron emitting layers are adjusted to predetermined values using an air micrometer. The cathode holder then is welded to the cylindrical cathode support at the side wall and thereby fixed in the electron gun assembly.

The cathode structure of the present invention has many advantages as follows. First, the deterioration of the electron emitting layer is much less. Enforced life tests of the invention cathode structure and the prior art cathode structure shown in FIG. 1 have been compared. Both cathode structures were built in electron guns of color cathode ray tubes. The ratio of remaining emission after the 3,000 hours life test, assuming an initial emission of 100%, was measured. The embodiment of the invention had about 80% and the prior art about 60%. The present invention clearly has a longer life than the prior art. According to the present invention, the metal substrate is welded to the cathode sleeves at only a few points and a space is formed between the cathode sleeves and the central part of the metal substrate. Therefore, chromium and tungsten contained in the cathode sleeve and oxygen resulting from the reaction between the alumina insulating layer and the tungsten filament do not substantially diffuse into the metal substrate. Thus, the electron emitting layer is poisoned less compared with the prior art. Particularly the electron emitting layer at the central portion will not be poisoned.

Second, an electron gun for a color cathode ray tube installing the present invention can be made compact. According to the present invention, the cathode holder is formed elliptical. When it is applied to the in-line electron gun and it is aligned parallel with respect to its major axis the in-line electron gun can be formed narrow. Particularly, in the embodiment the longitudinal direction of the cathode sleeve coincides with that of the cathode holder. This contributes to miniaturizing of the electron gun and minimizing the neck diameter of the cathode ray tube.

Third, the cathode structure operates quickly. The metal substrate is heated by not only the thermal conduction through the contact point between the metal subtrate and the thermal conductive member, but also by heat radiation from the thermal conductive member. Therefore, the metal substrate is quickly heated. In a color cathode ray tube with the above described embodiment of cathode structure, an image appears 1.8 seconds after the heater is energized. Another reason of quick starting is as follows. After applying the voltage to the heater, the temperature of the cathode sleeve rises from the central portion thereof and the metal substrate is heated quickly until the electron emitting layer is heated enough to emit thermions. After that, the temperature of the metal substrate will not rise excessively even though heating is continued. Both ends of the cathode sleeve are open and heat can be quickly dispersed. To this end, the metal substrate is held at a constant predetermined temperature. Further the inner and the outer surfaces of the cathode sleeve are blackened. Therefore, the heat absorption of the cathode sleeve becomes large, and the transmission speed of heat to the metal substrate is fast. The cathode structure thereby operates quickly. In a stationary state, the heat dispersion is large, and the metal substrate is prevented from reaching an excessively high temperature.

Fourth, the heater does not contact the metal substrate. The splash from the heater adheres to the cathode sleeve, but it does not adhere to the metal substrate. Therefore the electron emitting layer is free from deterioration caused by the reaction with splashed material.

Fifth, the metal substrate is welded to the cathode sleeve at only its peripheral portions. Even though the welding electrode material, for example copper, adheres to the metal substrate, it does not deteriorate the electron emitting layer.

Sixth, according to the present invention, the press forming step of the cathode sleeve after inserting the heater is eliminated. Therefore the opening of the filament and the electrical contact between the heater and the cathode sleeve is less.

Seventh, the cathode sleeves are supported symmetrically with respect to the electron gun axis. The thermal deformations of the parts scarcely affect the clearance between the electron emitting layer and the first grid electrode because of the rotating action absorbing the thermal deformations.

Figure 8:
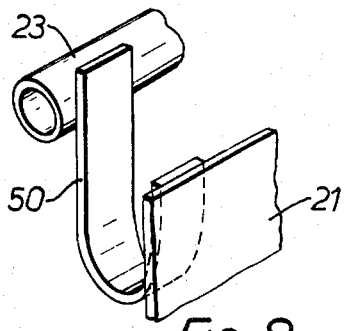
FIG. 8 is a perspective view of a supporting member of another embodiment.
Figure 9:
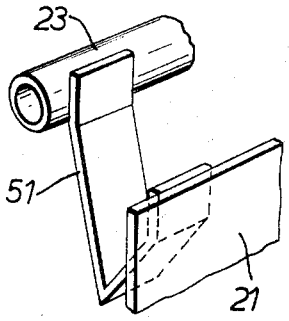
FIG. 9 is a perspective view of a supporting member of yet another embodiment.

FIGS. 8 and 9 show the other embodiments of the present invention. The described embodiment has a step-like supporting member 26 for supporting the cathode sleeve. However, a U-shape supporting member 50 as shown in FIG. 8 or a V-shape supporting member 51 as shown in FIG. 9 can be used.

Figure 10:
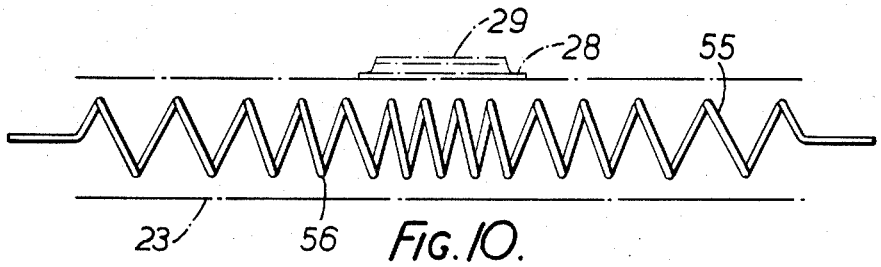
FIG. 10 is an enlarged cross section of a heater of another embodiment.

Referring now to FIG. 10, another embodiment is disclosed. The coiled filament 55 has a dense pitch portion 56 at the central portion of it and corresponding to metal substrate 28. This filament 55 is so called a variable pitched filament. The cathode structure having this heater can raise the temperature of the metal substrate faster than the above described embodiment at the same heater input power. This embodiment improves quick start operation even further.

Figure 11:
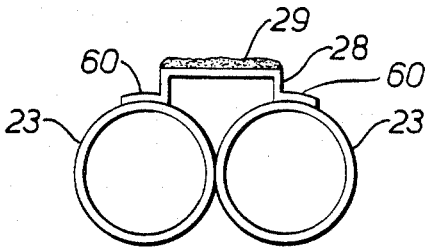
FIG. 11 is an enlarged cross section of a metal substrate of another embodiment.

The metal substrate can be used as a dish like metal substrate forming a step between an edge portion and a central portion as shown in FIG. 11 even though a flat disk is disclosed in the above described embodiment.

Figure 12:
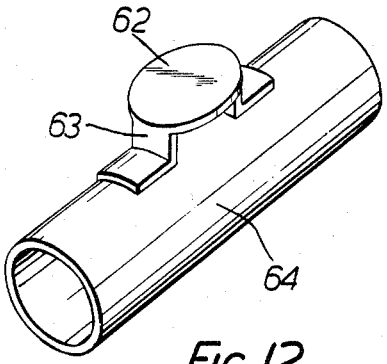
FIG. 12 is a perspective view of a metal substrate and a cathode sleeve of yet another embodiment.

The metal substrate is welded to the cathode sleeves at the edge portion 60. This structure has a long path between the welded portion and the central portion of the electron emitting layer. Therefore, very long life operation is expected. Further, the thermal conductive member can be constructed from one cathode sleeve as shown in FIG. 12. In this embodiment, a metal substrate 62 has lugs 63 for forming a space between the cathode sleeve 64 and the metal substrate. The metal substrate is welded to the cathode sleeve at the lugs. This embodiment is easy to assemble because of fewer parts. This cathode structure can also reduce power consumption. This embodiment also shows long lifetime because of the long path between the welded portion and the central portion of the electron emitting layer.

Furthermore, the shape of the cathode holder can be modified to a non-circular cylindrical shape, such as a rectangular cylinder, even though an elliptic cylinder is disclosed. Four conductive rods can also be provided for the respective ends of the heaters. Conductive members are gathered at one side of the cathode holder.

While the invention has been described in connection with what is presently considered to be the most practical and preferred embodiments, it is to be understood that the invention is not to be limited to the disclosed embodiments but on the contrary, is intended to cover various modifications and equivalent arrangements included with the spirit and scope of the appended claims which scope is to be accorded the broadest interpretation so as to encompass all such modifications and equivalent structures.

What is claimed is:

1. A cathode structure for an electron tube comprising:

a cathode holder;

a pair of metal sleeves arranged parallel each other;

two coiled filaments, each filament inserted in one said metal sleeve;

supporting means for connecting said metal sleeves to said cathode holder;

a metal substrate having a first surface facing said metal sleeves and a second surface, said substrate attached to both said metal sleeves to form a space between a central portion of said first surface and said metal sleeves; and an electron emitting member disposed on said second surface of said metal substrate.

2. A cathode structure for an electron tube according to claim 1, wherein said metal substrate is provided at the central portion of said metal sleeves.

3. A cathode structure for an electron tube according to claim 1, wherein said metal sleeves have blackened layers on their surfaces.

4. A cathode structure for an electron tube according to claim 1, wherein said metal substrate comprises a dish like metal substrate.

5. A cathode structure for an electron tube according to claim 1, wherein said cathode comprises an elliptical cylinder holder of an elliptical shape with the major axis of said elliptical cylinder parallel to the axis of said metal sleeves.

6. A cathode structure for an electron tube according to claim 1, wherein said coiled filament includes a dense pitch portion and sparse pitch portions.

7. A cathode structure for an electron tube according to claim 6, wherein said dense pitch portion of said coiled filament is located adjacent to said metal substrate.

8. A cathode structure for an electron tube according to claim 1, wherein said supporting means support said metal sleeves symmetrical with respect to an axis perpendicular to said second surface of said metal substrate and including a center of said second surface of said metal substrate.

9. A cathode structure for an electron tube according to claim 1, including means for mounting said cathode structure in an electron gun assembly.

* * * * *